US006206818B1

(12) United States Patent
Deschamps

(10) Patent No.: US 6,206,818 B1
(45) Date of Patent: Mar. 27, 2001

(54) TILE SURFACING FOR A CLASSIFIER OR CENTRIFUGE SCROOL

(75) Inventor: John Alexander Deschamps, Somerset (GB)

(73) Assignee: Tiletech Limited (GB)

( * ) Notice: Subject to any disclaimer, the term of this patent is extended or adjusted under 35 U.S.C. 154(b) by 0 days.

(21) Appl. No.: 09/214,853

(22) PCT Filed: Jun. 26, 1997

(86) PCT No.: PCT/GB97/01736

§ 371 Date: Mar. 16, 1999

§ 102(e) Date: Mar. 16, 1999

(87) PCT Pub. No.: WO98/02665

PCT Pub. Date: Jan. 22, 1998

(30) Foreign Application Priority Data

Jul. 12, 1996 (ZA) ..... 96/5927
Jul. 12, 1996 (ZA) ..... 96/5928

(51) Int. Cl.[7] ..... B04B 3/04

(52) U.S. Cl. ..... 494/54; 494/81; 210/374; 428/49; 416/224

(58) Field of Search ..... 494/54, 81; 428/49; 416/224; 366/320; 210/374

(56) References Cited

U.S. PATENT DOCUMENTS 4,328,925 * 5/1982 Shapiro ..... 494/54
5,429,581 * 7/1995 Michaud et al. ..... 494/54

FOREIGN PATENT DOCUMENTS 1 592 810 * 7/1981 (GB) .
7-171439 * 7/1985 (JP) .
81/02853 * 10/1981 (WO) .

* cited by examiner

*Primary Examiner*—David A. Reifsnyder
(74) *Attorney, Agent, or Firm*—Trexler, Bushnell, Giangiorgi & Blackstone, Ltd.

(57) ABSTRACT

A wear and/or abrasive resistant tile e.g. for use on a scroll of a classifier, comprises a front, working face and a rear, mounting face defined by an upper face portion and a lower face portion spaced rearwardly from the upper face portion, the upper and lower face portions being in parallel planes; an upwardly projecting, upper lip formation defining an upper edge of the lower face portion; a downwardly projecting lower lip formation defining a lower edge of both the lower face portion and the tile, the lower lip defined by a chamfered face extending towards the lower face portion, with a lower surface of lower lip formation being non-pointed, and stepped upwardly from a geometrically projected apex, and at least one groove provided in the rear mounting face of the tile. A carrier is also included, and the carrier has a transverse slot. Also included are a tile and carrier combination, and a scroll provided with tile and carrier combinations.

13 Claims, 5 Drawing Sheets

TILE SURFACING FOR A CLASSIFIER OR CENTRIFUGE SCROOL

BACKGROUND OF THE INVENTION

This invention relates to a tile, particularly a wear and/or abrasive resistant tile, to a tile carrier and to a tile and carrier combination.

DESCRIPTION OF PRIOR ART

It is known to employ ceramic, metallic, metallic alloys or the like tiles as at least part of a wear and/or abrasive resistant surface.

Thus, for example, it is known to mount such tile by means of a suitable bonding material on a carrier or the like which constitutes part of the blade or the like of apparatus intended to handle abrasive materials, such as, for example, classifiers; centrifuges etc. It is also known to employ a plurality of such tiles of wedge-like configuration in side-by-side abutting relationship to define the curved blade of such an apparatus.

The aforesaid carriers are usually of a suitable metal, and they are usually secured to the main body of the apparatus through welding or the like, the welding being carried out after the tiles have been bonded to the carriers by means of a suitable epoxy type adhesive, or the like.

The thermal shock involved in such welding operations can have a deleterious effect on the aforesaid bonding material which can result in the tiles becoming detached from their carriers during use.

OBJECT OF THE INVENTION

It is accordingly an object of this invention to provide an improved tile, tile carrier, and tile and carrier combination with which the aforesaid problems may be overcome or at least minimised.

SUMMARY OF THE VARIOUS ASPECTS OF THE INVENTION

According to a first aspect of the present invention, there is provided a tile, particularly a wear and/or abrasive resistant tile, having a front, working face, and a rear mounting face, a pair of spaced-apart, parallel slide surfaces associated with the rear mounting face, at least one of which slide surfaces is a lip formation, to provide, in use, for sliding, lateral insertion of the tile into a complementary receiving slot of a tile carrier, with the or each lip formation providing mechanical resistance to inadvertent detachment of the tile from its carrier, in a direction towards the front face.

The tile may be of alumina.

In a tile with one lip formation, the latter may be downwardly projecting, or upwardly projecting, and could be constituted by a web or flange. In a tile with two, opposed lip formations, one may be half dovetail.

At least one groove, typically of concave profile, may be provided in the rear face of the tile.

The tile may be of substantially wedge-like configuration having a pair of mutually inclined, radially extending end faces, a tangential innermost face, and an outermost face having a shallow, arcuate profile.

According to a second aspect of the present invention, of independent significance, there is provided a tile carrier to receive a tile, comprising a body memory having a laterally open slot defined at least in part by a pair of mutually facing, parallel mounting faces, between which faces spaced-apart, slide surfaces of a tile may be slid laterally, with a lip formation associated with at least one mounting face to provide mechanical resistance to inadvertent removal of a laterally inserted tile in a non-lateral, forward direction, and with an aperture communicating between a base of the slot and a rear opening of the tile, whereby an adhesive may be injected from outside the carrier through the aperture to enter the slot and make contact with a rear face of a laterally inserted tile.

Preferably, the carrier is of steel.

Preferably, the carrier is provided with two, mutually opposed lip formations, with at least one of the formations comprising a groove or half dovetail.

Bonding of a tile to its carrier may, for example, be effected through the employment of a suitable adhesive such as, for example, a suitable epoxy or the like.

Above the slot, the carrier may be provided with a transverse, planar support surface for a portion of the rear face of an inserted tile. To ensure contact of adhesive with such portion, the planar surface may be provided with a transverse groove, which stops short of the terminal ends of the support surface, the transverse groove being in communication with the slot, for fluid flow of adhesive, by means of an inter-connecting groove.

Preferably, the carrier is of such construction that, within limits, it may carry a range of tile sizes.

According to a third aspect of the present invention, of independent significance, there is provided a tile and carrier combination, with the carrier in accordance with the second aspect and with an adhesive accommodating space defined by a rear of a laterally inserted tile and the base of the slot, whereby injected adhesive fills this space to make contact with both the rear face or a substantial portion of the rear face, of a tile, and with the base of the slot, for bonded retention of the tile in the carrier, in addition to mechanical retention provided by the inter-engagement of the tile lip formations with the carrier slot.

It will be appreciated that with such an arrangement, the tile may be mounted on the carrier simply by bringing the said slide surfaces of the tile in the required inner-relationship with the slot of the carrier and then sliding the tile in a direction at right angles to the direction of the force that will be imposed on the tile in service; until the tile and carrier are in the required interlocking relationship. This third aspect thus provides both mechanical interlock, and chemical bond, between the tile and carrier.

Preferably, at what, in use, will be a radially outer end of the combination, the tile carrier protrudes beyond an outer edge of the tile so as to protect this edge during installation of the combined tile and carrier on a scroll etc.

According to a fourth aspect of the invention of independent significance, there is provided a scroll or other rotary member of apparatus such as a classifier or centrifuge provided with an array of tile and carrier combinations in accordance with the third aspect, such that the combinations describe a circle, with adjacent lateral edges of adjacent combinations in closely spaced, abutting relationship, whereby lateral displacement of a tile from its slot is precluded.

According to a fifth aspect of the insertion, there is provided a method of manufacturing a tile and carrier combination in accordance with the third aspect, comprising:

(i) inserting a tile laterally into a receiving groove of the carrier by inter-engagement of complementary slide surfaces;

(ii) welding the carrier to a scroll or similar component of a machine such as a classifier; and (iii) injecting an adhesive through the aperture of the carrier into the slot to make contact between a rear face of a laterally inserted tile, whereby the latter is secured not only mechanically but also by chemically bonding.

BRIEF DESCRIPTION OF THE DRAWINGS

Various aspects of the invention will now be described by way of example, with reference to the enclosed drawings, in which.

DETAILED DESCRIPTION OF THE DRAWINGS

Figure 1:
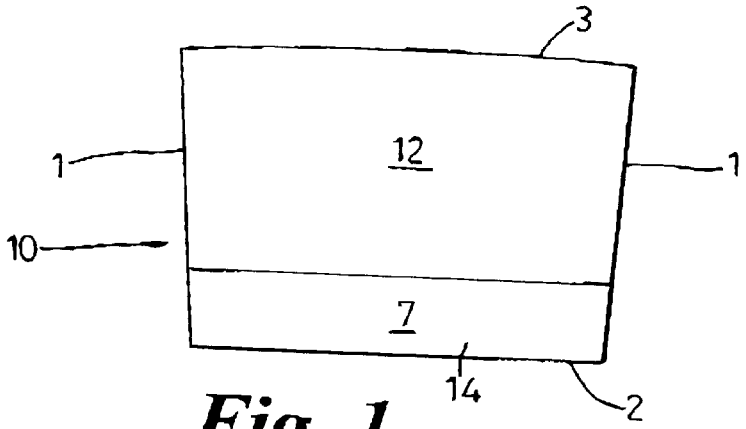
FIGS. 1–4 are, respectively, front elevation, rear elevation, plan view and section A—A of a first embodiment of tile in accordance with a first aspect of the invention.
Figure 2:
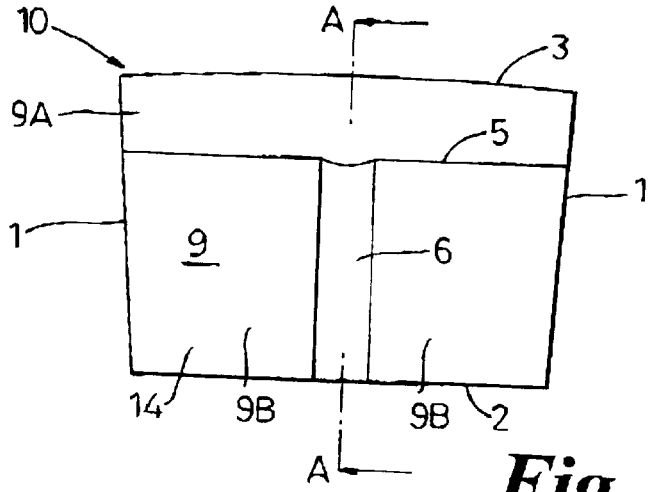
Figure 3:
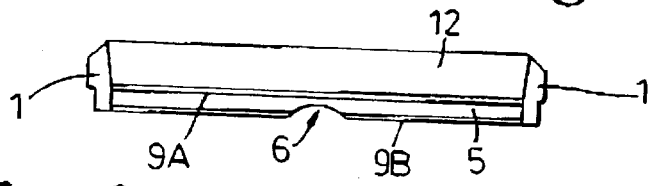
Figure 4:
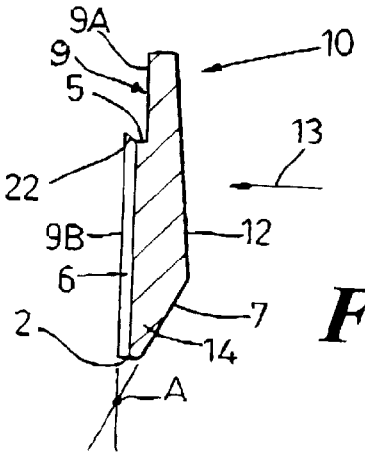
Figure 5:
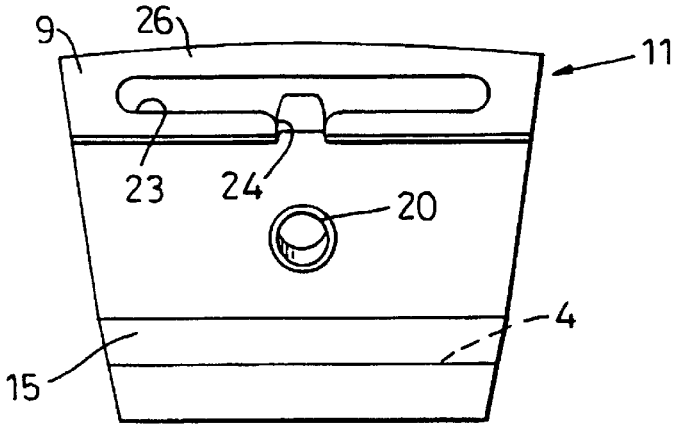
FIGS. 5–8 are, respectively, front elevation, rear elevation, Section B—B, and enlargement of the circled portion of FIG. 7 of a first embodiment of carrier in accordance with the second aspect of the invention.
Figure 6:
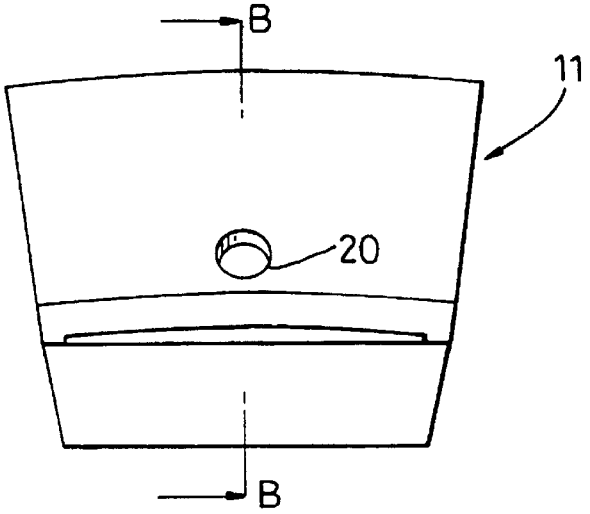
Figure 7:
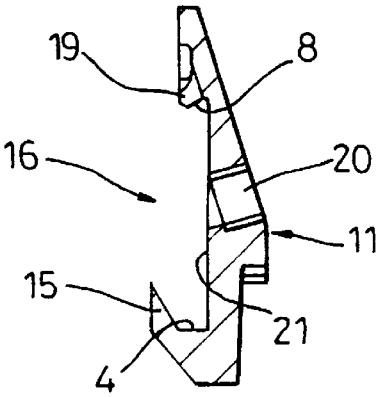
Figure 8:
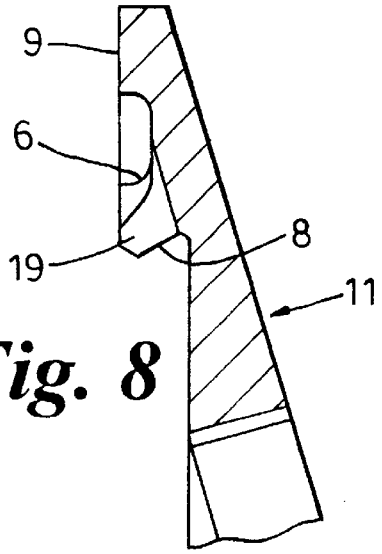

In all Figures, like component parts are allocated like reference numerals.

In FIGS. 1–4 is illustrated a tile 10 having a front, working face 12 and a rear, mounting face 9 defined by an upper face portion 9A and a lower face portion 9B spaced rearwardly from the upper face portion, the upper and lower face portions (9A and 9B) being in parallel planes.

The tile 10 may, for example, be of a suitable wear and/or abrasive resistant material such as alumina, a suitable metal, or metallic alloy, or the like, while carrier 11 may, for example, be of stainless steel.

As can be seen from FIGS. 1 to 4, in use, a force will be exerted on the tile 10 in the direction indicated by arrow 13, and the outline of the tile and carrier combination is of substantially wedge-like configuration having a pair of mutually inclined, radially extending end faces 1, a tangential innermost face which constitutes a surface 2, and an outermost face 3 having a shallow, arcuate profile.

The lower edge of the face portion 9B of the tile 10 together with a chamfered face 7 at the lower edge of the front working face 12 is defined by a lower lip formation 14 extending the full width of the tile 10, and terminating at the lower, transversely extending surface 2, whilst surface 5, parallel to the surface 2, is located part-way down the rear, mounting face 9 from which surface 5 extends a half dovetail, upper lip formation 22 which defines an upper edge of the rear face portion 9B. The otherwise planar rear, mounting face 9 is interrupted by a groove 6 extending from the face to the surface 5.

From FIGS. 5 to 8, it can be seen that the carrier 11 includes a transverse groove 16 defined between mutually facing, upper and lower parallel surfaces 8 and 4 respectively, adapted, in use, to be engaged by the surfaces 2 and 5 of a tile 1. A lip formation 15 extends upwardly from the lower surface 4, whilst a lip formation 19 extends downwardly from the upper surface 8, to define upper and lower half dovetailed shaped grooves for mechanical retention of a tile 10 within its carrier 11. An upper support face 26 of he carrier is provided with a transverse groove 23 stopping short of the ends of the carrier and, via a groove 24, communicating with the transverse groove 16 of the carrier 11.

Figure 9:
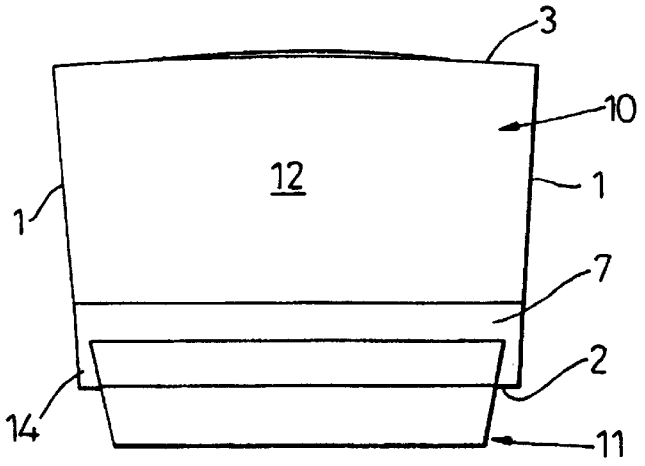
FIGS. 9, 10 and 11 are, respectively, diagrammatic front, rear and sectional views of the tile and carrier combination of FIGS. 1 to 8.
Figure 10:
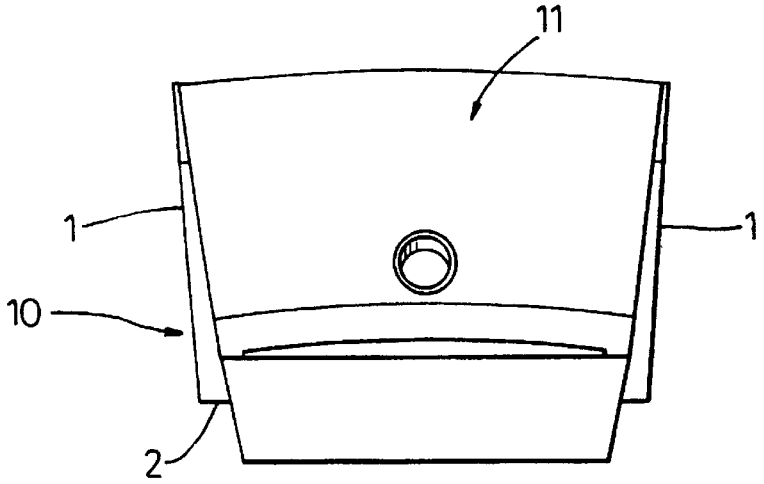
Figure 11:
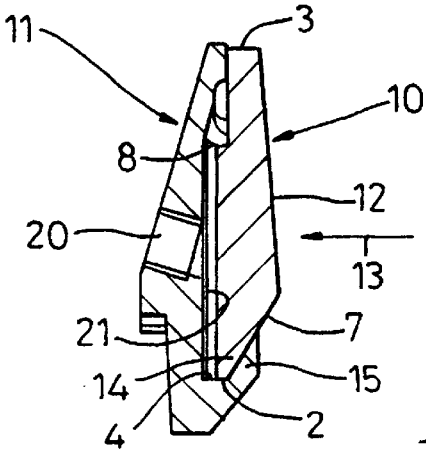

As indicated in FIGS. 9 to 11, tile 10 is mounted on carrier 11 by bringing one end of its lip formation 14 and one of its surface 5 in alignment with the open end of groove 16 and its mounting surface 8 and 4, and then sliding tile 10 relative to carrier 11 until both tile end faces 1 are slightly exposed, to the same extent beyond the carrier 11, can be seen in FIG. 10.

Figure 12:
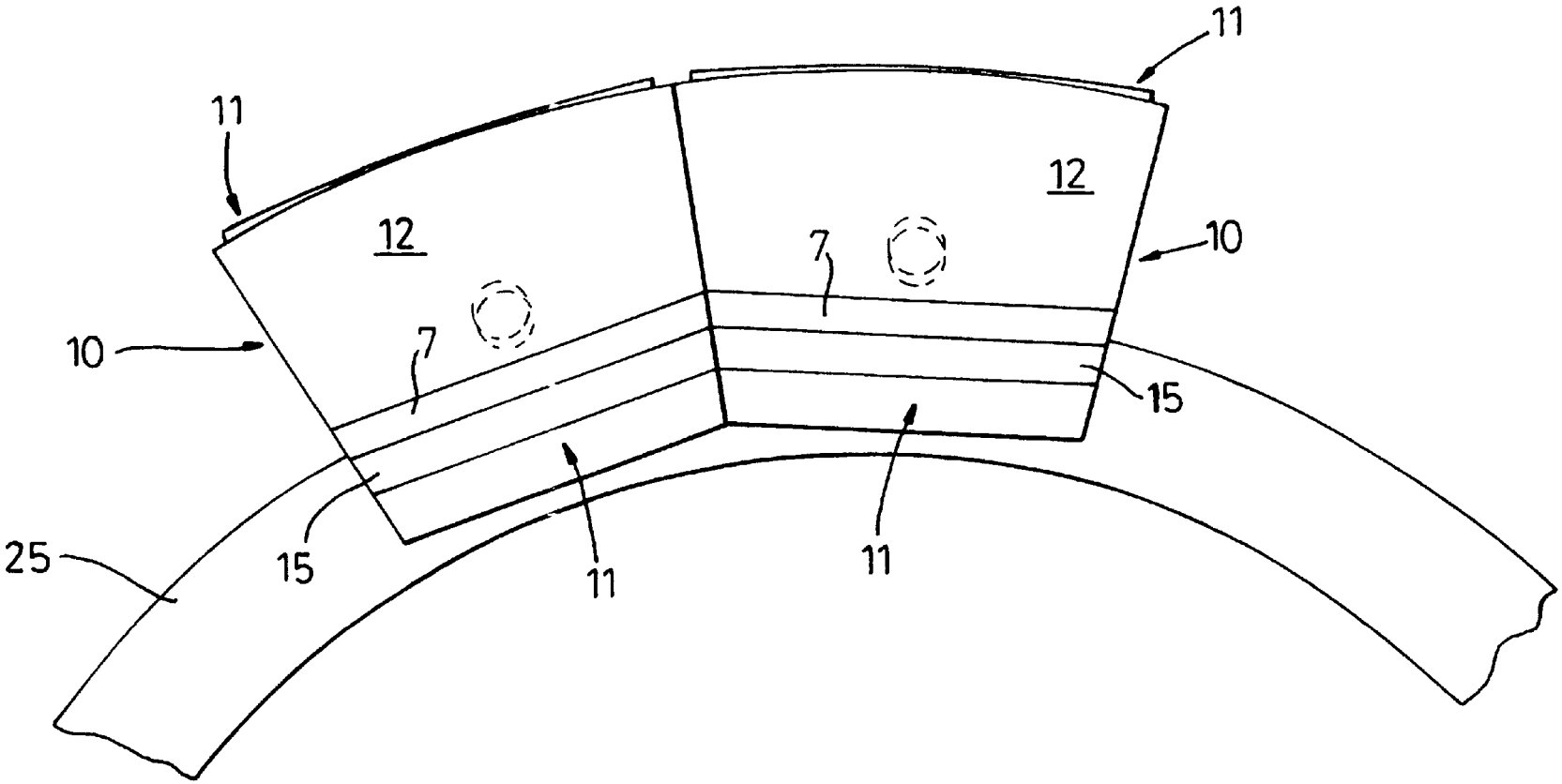
FIG. 12 indicates the side-by-side laterally abutting mounting on a scroll, of tile and carrier combination of FIGS. 9 to 11.
Figure 13:
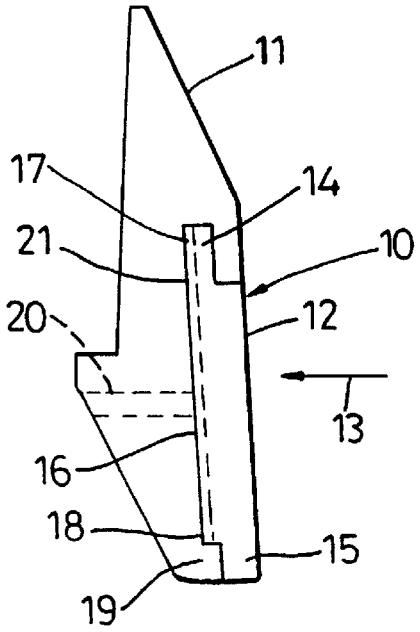
FIG. 13 corresponds to FIG. 11 but shows a second embodiment of tile and a second embodiment of carrier.
Figure 14:
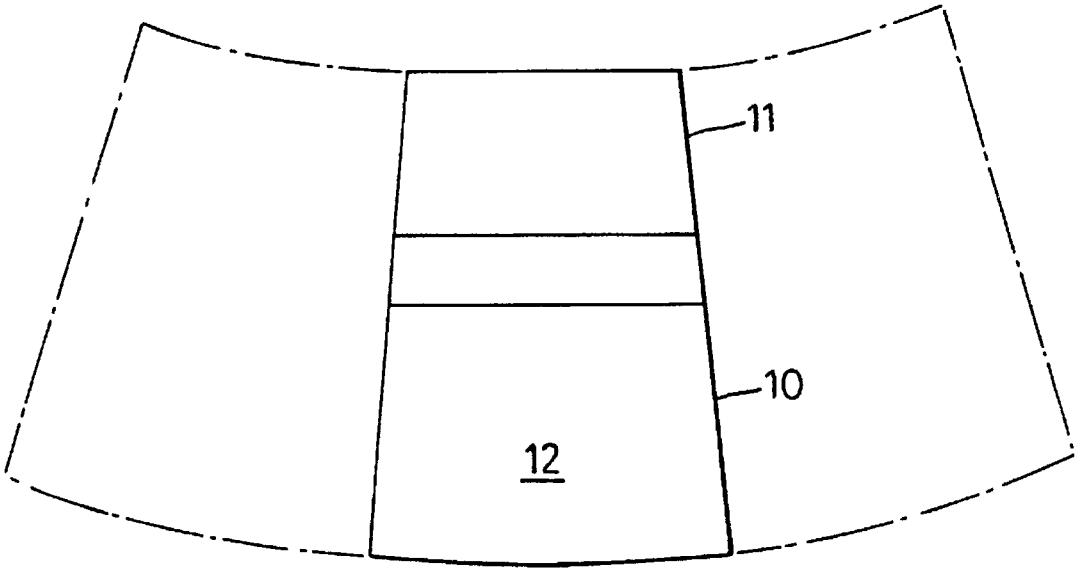
FIG. 14 indicates the side-by-side, laterally abutting mounting of an array of tile and carrier combinations of the FIG. 13 embodiment on a scroll etc., of a classifier etc.

With the tile 10 so mounted on carrier 11, the latter may be welded to a substructure, such as a scroll 25 of the relevant apparatus in its required position, so that, with a plurality of such combinations is located in side-by-side abutting relationship, as is indicated in FIGS. 12 and 14, they will collectively describe a circle which could, for example, be that of a circular or scroll-like blade, of an apparatus such as a classifier, centrifuge, etc.

In addition to the mechanical retention of the tile within its carrier—provided by inter-engagement of the lip formations. the tile 10 may be chemically bonded to carrier 11 by applying thereto an adhesive, such as a suitable epoxy, for example, which may be deposited into a relatively narrow gap 17 between the rear face 9 of tile 10 and a base 21 of the transverse groove 16 on carrier 11 and also into the groove 6 by injecting, from the outside, a flowable epoxy through a passage or aperture 20 in carrier 11, and, via the gap 17, into the grooves 24 and 23 with, as stated previously, this chemical bonding effected after the carrier 11 has been welded to the scroll 25.

What is claimed is:

1. A tile comprising:

(i) a front working face and a rear mounting face defined by an upper face portion and a lower face portion spaced rearwardly from the upper face portion, the upper and lower face portions being in parallel planes;

(ii) an upwardly projecting, upper lip formation defining an upper edge of the lower face portion; and (iii) a downwardly projecting lower lip formation defining a lower edge of both the lower face portion and the tile, characterized in that (iv) the lower lip is defined by a chamfered face extending towards the lower face portion with a lower surface of lower lip formation being non-pointed, and stepped upwardly from a geometrically projected apex, and wherein at least one groove is provided in the rear mounting face of the tile.

2. A tile as claimed in claim 1, wherein the tile is comprised of alumina.

3. A tile as claimed in claim 1 or claim 2, characterized in that said upper lip formation is half-dovetail.

4. A tile as claimed in claim 1 or claim 2, characterized by being of substantially wedge-like configuration having a pair of mutually inclined, radially extending end faces, an innermost face, and an outermost face having a shallow, arcuate profile.

5. A tile carrier to receive a tile, comprising:

(i) a transverse, tile receiving groove defined at least in part by a base and an upwardly projecting lip formation;

(ii) a downwardly projecting lip formation to provide mechanical resistance to tile removal to supplement adhesive securing of a tile to a carrier;

(iii) a surface projecting forwardly from the base of the tile receiving groove;

(iv) the upwardly projecting lip formation extends from an end of the surface distal from the base so that the upwardly projecting lip formation is displaced forwardly with respect to the downwardly projecting lip formation, and (v) an aperture communications between the base of the groove and a rear surface of the tile carrier.

6. A carrier as claimed in claim 5, wherein said tile carrier is comprised of steel.

7. A carrier as claimed in claim 5 or claim 6, characterized in that, above the receiving groove, the carrier is provided with a transverse, support face for a portion of the rear face of an inserted tile.

8. A carrier as claimed in claim 7, characterized in that the face is provided with a transverse groove, which stops short of terminal ends of the face, the transverse groove being in communication with the receiving groove, for fluid flow of adhesive, by means of an inter-connecting groove.

9. A tile and carrier combinations, wherein the tile includes a front working face and a rear mounting face defined by an upper face portion and a lower face portion spaced rearwardly from the upper face portion, the upper and lower face portions being in parallel planes; an upwardly projecting, upper lip formation defining an upper edge of the face portion; and a downwardly projecting lower lip defining a lower edge of both the face portion and the tile, wherein the lower lip is defined by a chamfered face extending towards the face portion with a lower surface of lower lip being non-pointed, and stepped upwardly from a geometrically projected apex, and wherein the carrier includes: a transverse, tile receiving groove defined at least in part by a base and an upwardly projecting lip formation; a downwardly projecting lip formation to provide mechanical resistance to tile removal to supplement adhesive securing of a tile to a carrier; a surface projecting forwardly from the base of the tile receiving groove, wherein the upwardly projecting lip formation extends from an end of the surface distal from the base so that the upwardly projecting lip formation is displaced forwardly with respect to the downwardly projecting lip formation, wherein an adhesive accommodating space is defined by a rear face of a tile and the base of the groove.

10. A tile and carrier combination as claimed in claim 9, characterized in that at what, in use, will be a radially outer end of the combination, the carrier protrudes beyond an outer edge of the tile so as to protect this edge during installation of the combined tile and carrier on a scroll.

11. A scroll or other rotary member of apparatuses such as a classifier or centrifuge characterized in that it is provided with a plurality of tile and carrier combinations in side-by-side array such that the combinations are in closely spaced, abutting relationship, whereby lateral displacement of a tile is precluded, wherein each combination includes a tile that includes a front working face and a rear mounting face defined by an upper face portion and a lower face portion spaced rearwardly from the upper face portion, the upper and lower face portions being in parallel planes; an upwardly projecting, upper lip formation defining an upper edge of the face portion; and a downwardly projecting lower lip defining a lower edge of both the face portion and the tile, wherein the lower lip is defined by a chamfered face extending towards the face portion with a lower surface of lower lip being non-pointed, and stepped upwardly from a geometrically projected apex, and wherein each carrier includes: a transverse, tile receiving groove defined at least in part by a base and an upwardly projecting lip formation; a downwardly projecting lip formation to provide mechanical resistance to tile removal to supplement adhesive securing of a tile to a carrier; a surface projecting forwardly from the base of the tile receiving groove, wherein the upwardly projecting lip formation extends from an end of the surface distal from the base so that the upwardly projecting lip formation is displaced forwardly with respect to the downwardly projecting lip formation, wherein an adhesive accommodating space is defined by a rear face of a tile and the base of the groove.

12. A scroll or other rotary member as claimed in claim 11, characterized in that the carrier of each tile and carrier combination, is secured to the rotary member by welding, before the application of adhesive.

13. A scroll or other rotary member as claimed in claim 11, characterized in that at what, in use, will be a radially outer end of the combination, the carrier of each combination protrudes beyond an outer edge of the tile so as to protect this edge during installation of the combined tile and carrier on a scroll.

* * * * *